US010583683B1

(12) United States Patent
Ridenour et al.

(10) Patent No.: US 10,583,683 B1
(45) Date of Patent: Mar. 10, 2020

(54) EMBEDDED METAL CARD AND RELATED METHODS

(71) Applicant: Federal Card Services, LLC, Cincinnati, OH (US)

(72) Inventors: Doug Ridenour, Cincinnati, OH (US); Aaron Tucker, Cincinnati, OH (US)

(73) Assignee: Federal Card Services, LLC, Cincinnati, OH (US)

( * ) Notice: Subject to any disclaimer, the term of this patent is extended or adjusted under 35 U.S.C. 154(b) by 2 days.

(21) Appl. No.: 15/887,584

(22) Filed: Feb. 2, 2018

Related U.S. Application Data

(60) Provisional application No. 62/454,481, filed on Feb. 3, 2017.

(51) Int. Cl.

| | |
|---|---|
| ***B42D 25/455*** | (2014.01) |
| ***B42D 25/46*** | (2014.01) |
| ***B42D 25/475*** | (2014.01) |
| ***B42D 25/485*** | (2014.01) |
| ***B42D 25/373*** | (2014.01) |
| ***B42D 25/47*** | (2014.01) |

(52) U.S. Cl.
CPC ..... *B42D 25/455* (2014.10); *B42D 25/373* (2014.10); *B42D 25/46* (2014.10); *B42D 25/47* (2014.10); *B42D 25/475* (2014.10); *B42D 25/485* (2014.10)

(58) Field of Classification Search
None
See application file for complete search history.

(56) References Cited

U.S. PATENT DOCUMENTS

| | | | | |
|---|---|---|---|---|
| 3,987,725 | A * | 10/1976 | Scantlin | B41M 1/12 101/128.4 |
| 4,668,314 | A * | 5/1987 | Endoh | G06F 15/0216 156/267 |
| 6,471,128 | B1 | 10/2002 | Corcoran et al. | |
| 6,644,551 | B2 | 11/2003 | Clayman et al. | |
| 6,644,552 | B1 | 11/2003 | Herslow | |
| 6,924,026 | B2 | 8/2005 | Jaynes | |
| 7,073,721 | B2 * | 7/2006 | Kano | B29C 65/7808 235/487 |
| 7,287,704 | B2 | 10/2007 | Herslow | |
| 7,494,057 | B2 | 2/2009 | Lasch et al. | |
| 7,503,503 | B2 | 3/2009 | Riedl et al. | |
| 7,530,491 | B2 | 5/2009 | Lasch et al. | |

(Continued)

FOREIGN PATENT DOCUMENTS

| | | |
|---|---|---|
| WO | WO 01/18745 | 3/2001 |

*Primary Examiner* — Christie I Marshall
(74) *Attorney, Agent, or Firm* — Frost Brown Todd LLC

(57) ABSTRACT

A system and method for producing a multi-layered materials sheet that can be separated into a number of payment cards having an embedded metal layer that provides durability and aesthetics at a reduced cost and increased efficiency. During product of the materials sheet, multiple layers are collated and laminated to produce a large materials sheet. The lamination step involves heating and cooling the materials at specific temperatures and pressures for specific time periods. At a registration step, the sheet is automatically milled with alignment holes. During a singulation step, the alignment holes are used to position the sheet on a vacuum table, and vacuum holds the sheet in place while a milling device cuts cards from the sheet.

20 Claims, 16 Drawing Sheets

(56) References Cited

U.S. PATENT DOCUMENTS 7,544,266 B2 6/2009 Herring et al.
7,588,184 B2 9/2009 Gandel et al.
7,819,310 B2 10/2010 Lasch et al.
7,823,777 B2 11/2010 Varga et al.
7,971,786 B2 7/2011 Lasch et al.
8,033,457 B2 10/2011 Varga et al.
8,061,618 B2 11/2011 Mosteller
8,079,514 B2 12/2011 Lasch et al.
8,186,582 B2 5/2012 Varga et al.
8,317,231 B2 11/2012 Heim et al.
8,360,312 B2 1/2013 Varga et al.
D677,330 S 3/2013 Blum
8,393,547 B2 3/2013 Kiekhaefer et al.
D687,886 S 8/2013 Ahrabian
8,523,062 B2 9/2013 Varga et al.
8,640,948 B2 2/2014 Blum
8,672,232 B2 3/2014 Herslow
8,725,589 B1 5/2014 Skelding et al.
8,857,722 B2 10/2014 Mosteller
8,944,810 B2 2/2015 Herslow
D728,017 S 4/2015 Liddy et al.
9,016,591 B2 * 4/2015 Herslow ..... G06K 19/02 235/488
9,058,547 B2 6/2015 Oh et al.
9,070,053 B2 6/2015 Mosteller
9,076,093 B2 7/2015 Seo et al.
9,117,155 B2 8/2015 Mosteller
9,390,363 B1 * 7/2016 Herslow ..... B29C 59/026
9,390,366 B1 7/2016 Herslow et al.
9,430,724 B2 8/2016 Mosteller
9,440,481 B1 9/2016 Thomson et al.
9,466,019 B2 10/2016 Blum
9,542,635 B2 1/2017 Herslow
9,547,814 B2 1/2017 Mosteller
9,569,718 B2 2/2017 Herslow
9,665,814 B2 5/2017 Blum
9,779,343 B2 10/2017 Mosteller
2008/0314990 A1 * 12/2008 Rietzler ..... G06K 19/07749 235/492
2009/0169776 A1 7/2009 Herslow
2011/0189620 A1 8/2011 Herslow
2012/0295089 A1 11/2012 Crawford-Taylor et al.
2013/0168454 A1 7/2013 Oh et al.
2013/0320095 A1 12/2013 Blum
2014/0138443 A1 5/2014 Blum
2014/0144993 A1 5/2014 Seo et al.
2014/0158773 A1 6/2014 Blum
2014/0166762 A1 6/2014 Herslow
2014/0224881 A1 * 8/2014 Herslow ..... G06K 19/02 235/488
2015/0041546 A1 2/2015 Herslow et al.
2015/0136856 A1 * 5/2015 Herslow ..... G01B 7/06 235/488
2015/0180229 A1 * 6/2015 Herslow ..... G06K 19/07749 361/56
2015/0206047 A1 7/2015 Herslow et al.
2015/0339564 A1 11/2015 Herslow et al.
2017/0017871 A1 * 1/2017 Finn ..... G06K 19/07722
2017/0185885 A1 6/2017 Skelding et al.
2018/0339503 A1 * 11/2018 Finn ..... G06K 19/02

* cited by examiner

EMBEDDED METAL CARD AND RELATED METHODS

CROSS-REFERENCE TO RELATED APPLICATION

This application claims priority to application Ser. No. 62/454,481 filed on Feb. 3, 2017 entitled "Embedded Metal Card and Related Methods", the disclosure of which is hereby expressly incorporated by reference herein, in its entirety.

FIELD

The disclosed technology pertains to a system for producing embedded metal cards for use in payment or other applications.

BACKGROUND

Lenders and banks print and issue tens or hundreds of millions of payment cards every year. With slim margins and increasingly competitive rewards programs, card providers sometimes differentiate their cards on aesthetic features, such as sports team branding, artistic designs, and personalization with family photos. Efforts to differentiate payment cards are somewhat limited, since cards must meet certain basic form factor requirements such as having a CR80 or ISO/IEC 7810 ID-1 size and format, which specifies the cards height, width, and depth.

One differentiator that has emerged is card material, with some premium cards having a metal body. A metal body payment card may offer various advantages such as durability, additional finish and design options, and a premium or luxury weight and feel when held or touched. Metal payment cards are often available to those who meet certain financial or lending requirements and may be paired with significant annual fees. To at least some extent, such annual fees for metal payment cards are due to the relatively high cost of producing metal payment cards. In contrast, plastic payment cards can be cheaply produced with simple tools and processes for cutting and printing on plastic. Since metal payment cards require more expensive materials for manufacturing with advanced tools for cutting, etching, and milling one or more metals, such as stainless steel, the cost of producing a single card can be upwards of 50 USD.

As competition increases and more card providers move towards premium payment cards, it may be advantageous to have systems and processes that can produce payment cards, in whole or in part, with improved quality, durability, efficiency, and/or reduced costs. Accordingly, there is a need for an improved payment card having metal therein and related system for producing such a payment card that addresses the present challenges such as those discussed above.

BRIEF DESCRIPTION OF THE DRAWINGS

The drawings and detailed description that follow are intended to be merely illustrative and are not intended to limit the scope of the invention as contemplated by the inventors.

DETAILED DESCRIPTION

The inventors have conceived of novel technology that, for the purpose of illustration, is disclosed herein as applied in the context of payment card production. While the disclosed applications of the inventors' technology satisfy a long-felt but unmet need in the art of payment card production, it should be understood that the inventors' technology is not limited to being implemented in the precise manners set forth herein, but could be implemented in other manners without undue experimentation by those of ordinary skill in the art in light of this disclosure. Accordingly, the examples set forth herein should be understood as being illustrative only, and should not be treated as limiting.

Figure 1:
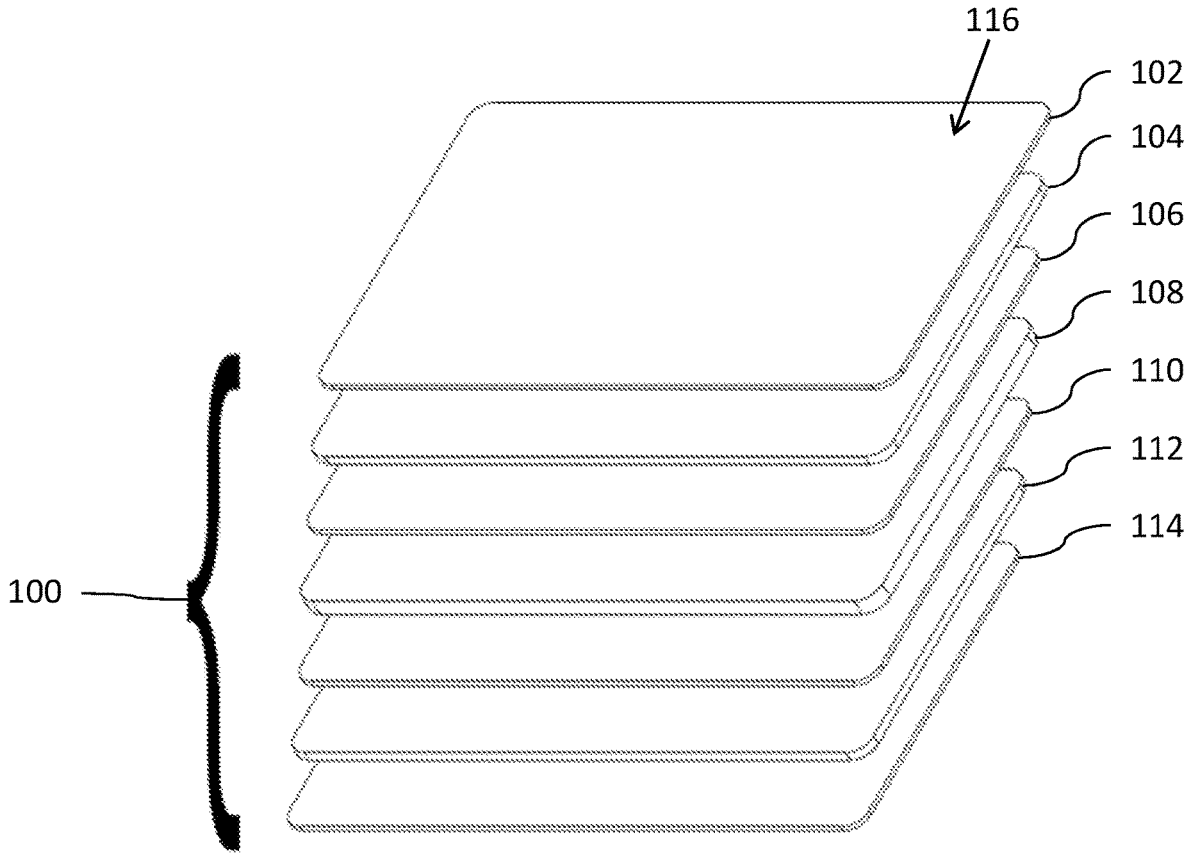
FIG. 1 is an exploded perspective view of a payment card with a body having a plurality of layers.

Turning now to the figures, FIG. 1 shows a body (116) with a plurality of layers (102, 104, 106, 108, 110, 112, 114) that are combined to form a transaction card (100), also referred to herein as a payment card (100). More particularly, the layers (102, 104, 106, 108, 110, 112, 114) forming the payment card (100) in this example include a bottom and top overlay (102, 114), a bottom and top print layer (104, 112), a bottom and top bonding layer (106, 110), and a central metal layer (108). The present example of payment card (100) thus has seven layers (102, 104, 106, 108, 110, 112, 114), although alternative numbers of layers, such as more or less layers, may be applied in alternative examples. The invention is thus not intended to be unnecessarily limited to seven layers (102, 104, 106, 108, 110, 112, 114).

The overlay layers (102, 114) may be a plastic or other clear bondable material, such as a laser engravable polyvinyl chloride having a thickness of approximately 0.003 inches. The print layers (104, 112) may be a plastic or paper material that can accept various types of printed words, images, and colors, and may be, for example, a polyvinyl chloride having a thickness of approximately 0.006 inches. The bonding layers (106, 110) may be a plastic or adhesive layer such as, for example, polyethylene terephthalate, having a thickness of around 0.003 inches. The metal layer (108) may be a metal of any suitable type such as, for example, tempered stainless steel, titanium, aluminum, or other metals that provide durability and aesthetics, having a thickness of approximately 0.01 inches. The layers (102, 104, 106, 108, 110, 112, 114) are selected and arranged as shown so that during a heated and pressurized lamination process, as will be described in further detail below, each layer (102, 104, 106, 108, 110, 112, 114) will be bound to any other transversely adjacent layer (102, 104, 106, 108, 110, 112, 114). For example, the overlay (102), when heated and cooled, will bind to the print layer (104), while the bonding layer (106) will bind to the print layer (104) and the metal layer (108), and so on. The resulting layered payment card (100) will be durable, resistant to delamination, and have a thickness of between approximately 0.027 inches and approximately 0.033 inches. More particularly, such thickness may be between approximately 0.032 inches and approximately 0.033 inches. In addition, such thickness may be increased in cases of a PLV finish to payment card (100).

Figure 2:
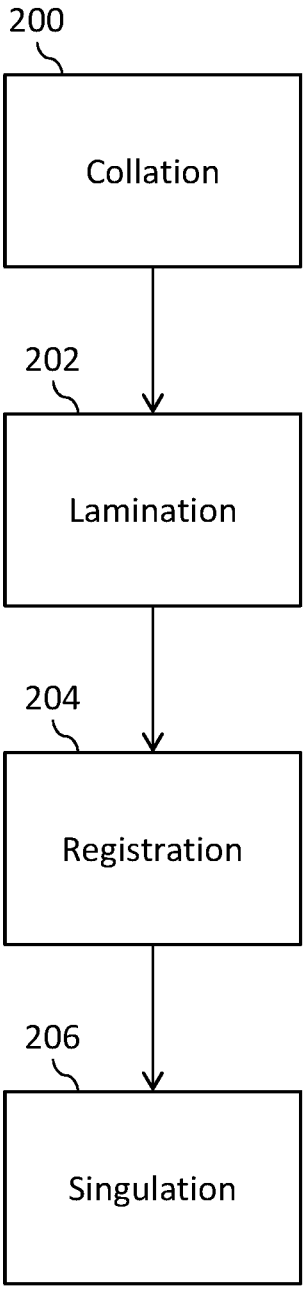
FIG. 2 is a flowchart of a set of high-level steps that a system could perform to produce the payment card shown in FIG. 1.
Figure 7:
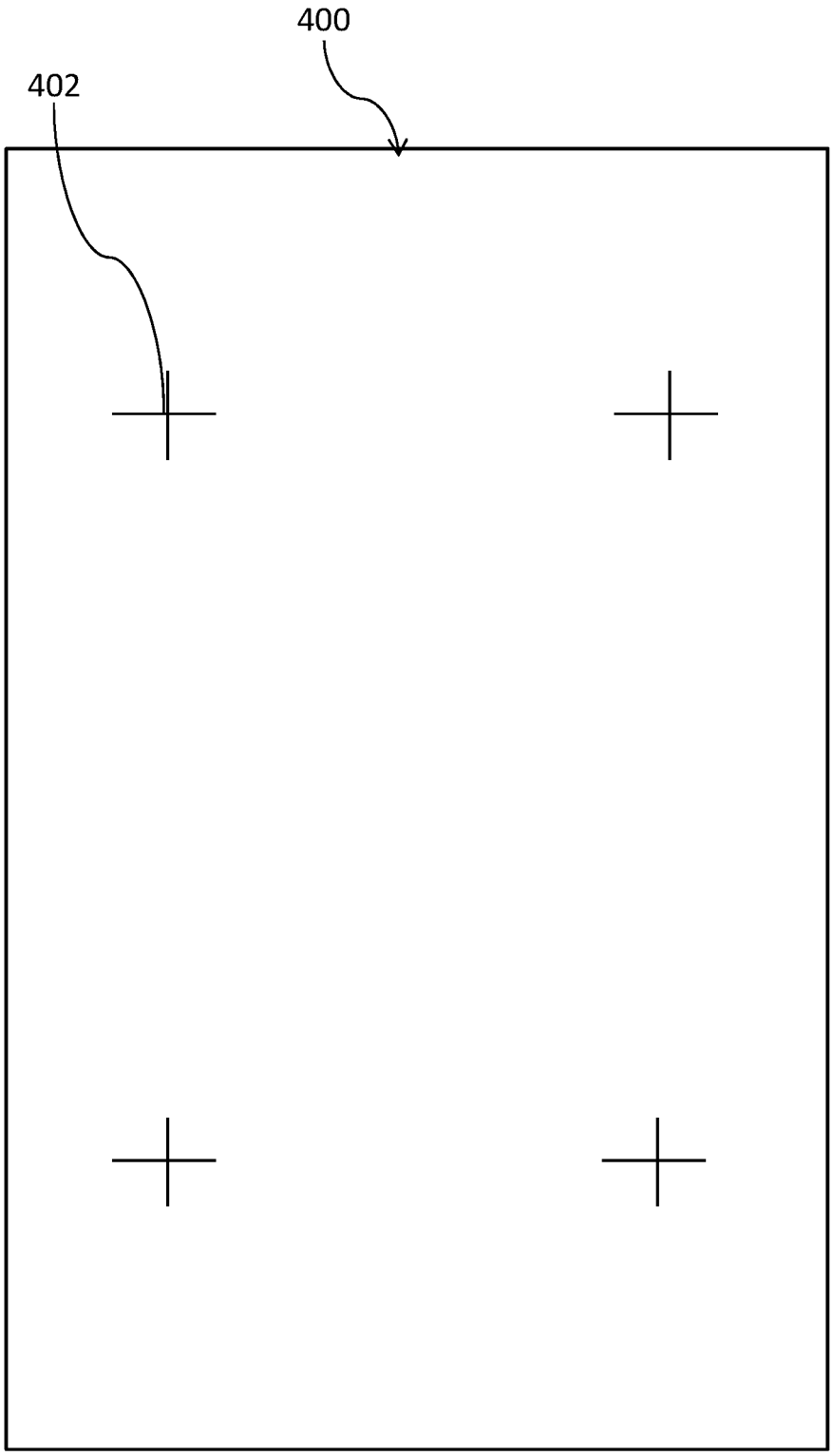
FIG. 7 is a top view of the materials sheet before registration.

FIG. 2 shows a flowchart of a set of high-level steps that a system could perform to produce the payment card (100) described above, or other like payment card. During a collation step (200), sheets of layers (102, 104, 106, 108, 110, 112, 114) are stacked and aligned using automated positioning devices and imaging devices to ensure proper placement. Such material sheets of layers (102, 104, 106, 108, 110, 112, 114) may be of varying sizes depending upon available equipment. One exemplary size that is flexible and appropriate for a broad spectrum of equipment is approximately 13 inches by approximately 18.5 inches, with layer thicknesses as described above in relation to FIG. 1. In the present example, sheets of this size may be processed into approximately 20-30 individual payment cards (100) depending upon equipment. In another example, such sheet may be sized to accommodate less than 54 payment cards (100), and, more particularly, less than or equal to 45 payment cards (100) for reasons discussed below in great detail. During a lamination step (202), the material sheets, which may also be referred to herein as layers, undergo a heating and cooling cycle to securely bond the layers (102, 104, 106, 108, 110, 112, 114) in a transverse direction, top to bottom, forming a relatively rigid materials sheet (400) as shown in one example in FIG. 7.

Referring back to FIG. 2, during a registration step (204), the materials sheet (400) is identified by an automated cutting machine based upon reference indicators (402), such as symbols or markings, and a number of alignment holes (404) are milled into the materials sheet (400) using the indicators. During a singulation step (206), the materials sheet (400) is placed on a vacuum table using the alignment holes (404) and vacuum locked in place while individual payment cards (100) are cut from the materials sheet (400). Each step (200, 202, 204, 206) will be described in more detail below. As used herein, the term "sheet" may be a single layer of material, such as sheet of layer material, or may be a collection of layers adhered together, such as materials sheet (400). The term "sheet" is thus not intended to unnecessarily limit the invention to a particular number of layers as described herein.

Figure 3:
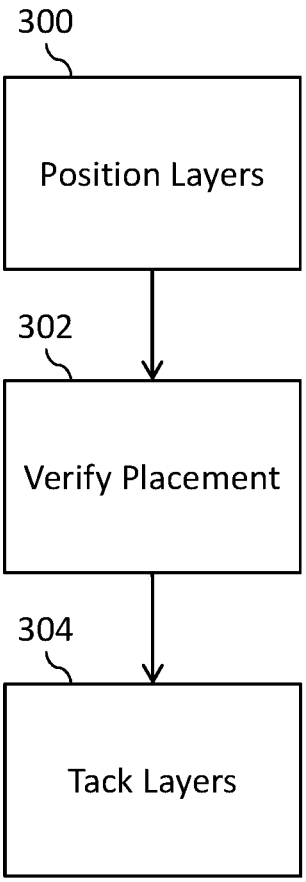
FIG. 3 is a flowchart of a set of steps that a system could perform to collate the plurality of layers of FIG. 1 into a materials sheet for producing payment cards.

FIG. 3 is a flowchart of a set of steps that a system could perform to collate the layers (102, 104, 106, 108, 110, 112, 114) of materials sheet (400) that may be used to produce payment cards (100). The steps of FIG. 3 may be performed by a custom collation machine (500) such as that shown in FIG. 13. The collation machine (500) of FIG. 13 comprises a set of visual monitors (502), a set of tacking heads (504), a position grip (506), and a pressure grip (508). The position grip (506) and pressure grip (508) may be used to move and position one or more layers (102, 104, 106, 108, 110, 112, 114) based upon feedback from the visual monitors (502). For example, a visual monitor (502) may be a camera or other imaging device that can determine based upon an edge image of a number of stacked layers (102, 104, 106, 108, 110, 112, 114) that one or more layers (102, 104, 106, 108, 110, 112, 114) need to be rotated or moved in order to align with the other layers (102, 104, 106, 108, 110, 112, 114). Based upon this, the position grip (506) may be activated to reposition and align the layers (102, 104, 106, 108, 110, 112, 114) as needed, while the pressure grip (508) may be applied to hold them in place once aligned. The tacking heads (504) may be automatically positioned and oriented in order to heat and provide spot welding or tacking of the materials sheet's (400) material layers (102, 104, 106, 108, 110, 112, 114) to keep them in their desired alignment until the full lamination process can be completed.

Figure 13:
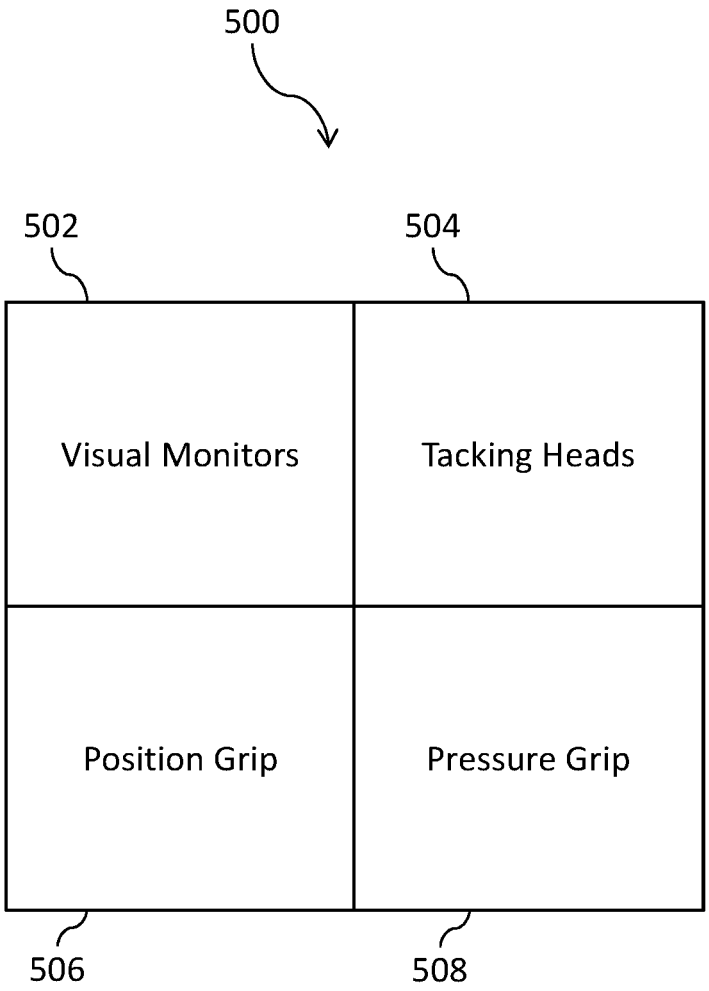
FIG. 13 is a schematic view of a collation machine that may be used during the collation process of FIG. 3.

Referring to FIG. 2, FIG. 3, and FIG. 13, the collation machine (500) may perform the collation process (200) by positioning the layers (102, 104, 106, 108, 110, 112, 114) in a step (300) with the position grip (506), verify alignment with the visual monitors (502) in a step (302), and then tack the layers (102, 104, 106, 108, 110, 112, 114) together in one or more locations with the tacking heads (504) in a step (304). In some embodiments, the tacking heads (504) may spot weld or tack the layers (102, 104, 106, 108, 110, 112, 114) in areas that will later be discarded (e.g., a corner, edge, or a location between two prospective payment cards) in order to provide some rigidity to the materials sheet (400) and maintain alignment while moved to lamination step (202).

Figure 4:
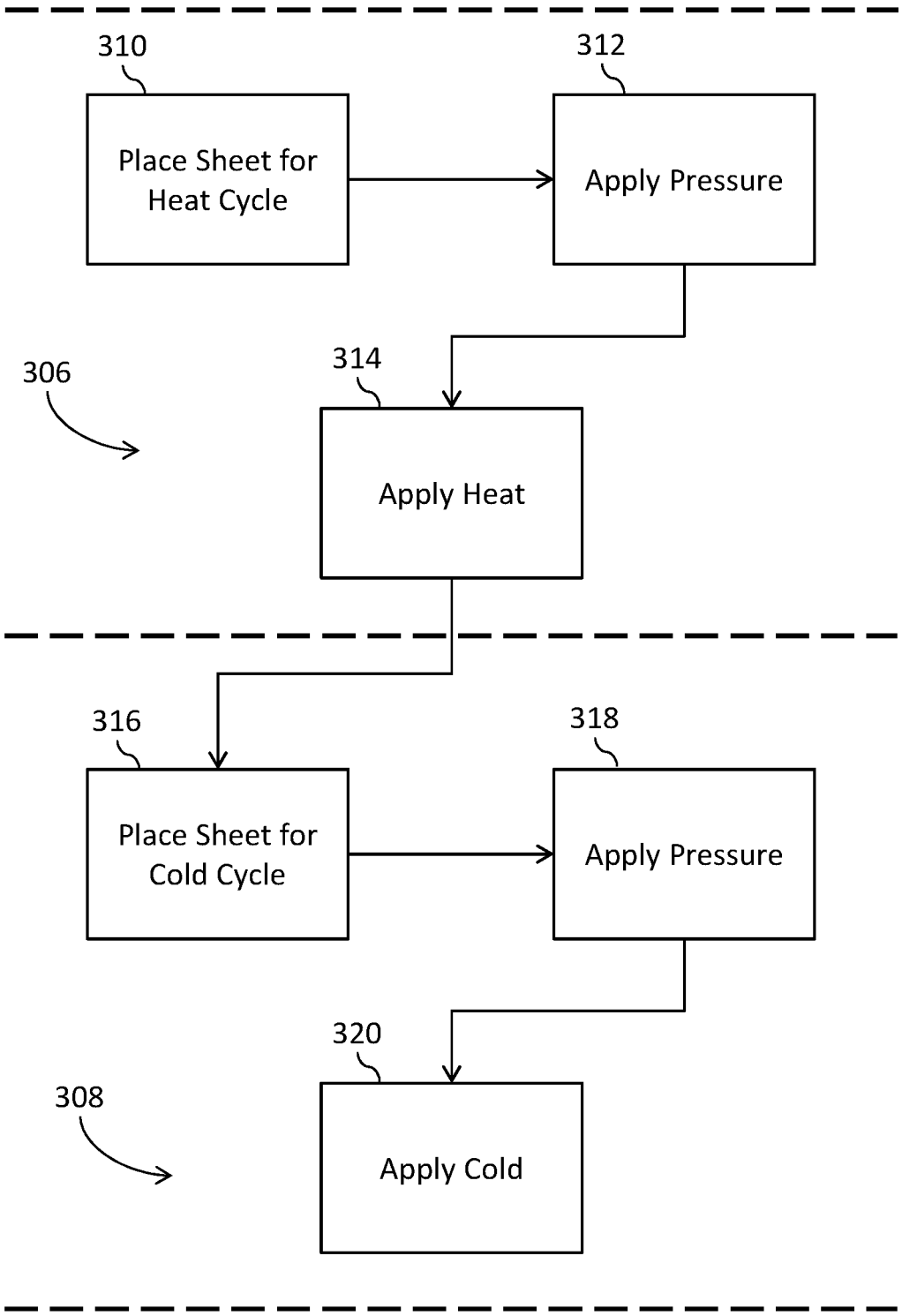
FIG. 4 is a flowchart of a set of steps that a system could perform to laminate the plurality of layers of FIG. 1 into the materials sheet.
Figure 14:
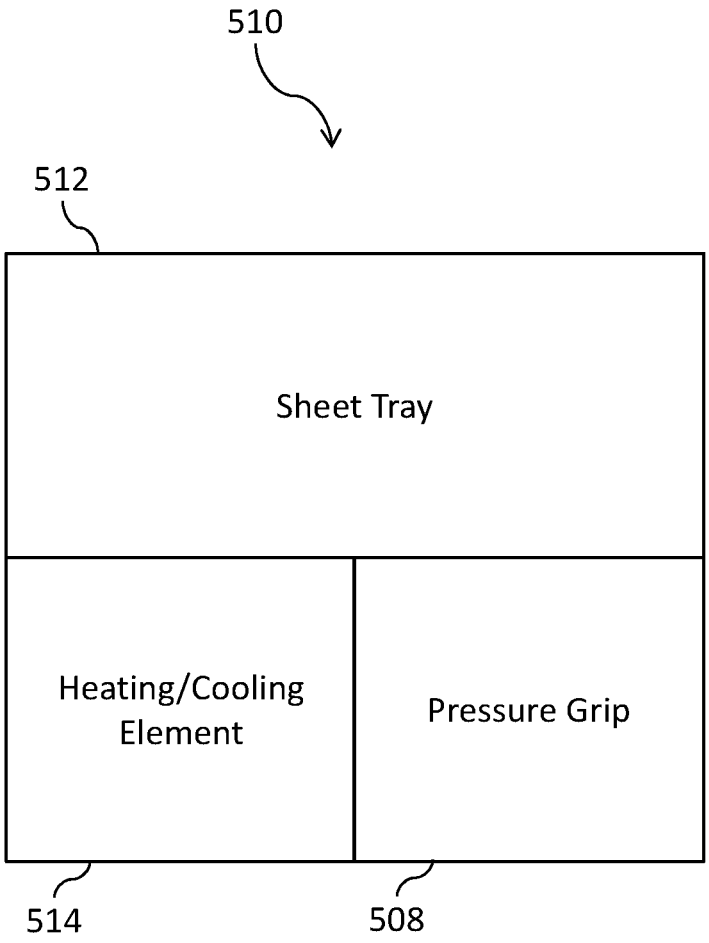
FIG. 14 is a schematic view of a lamination machine that may be used during the lamination process of FIG. 4.

FIG. 4 is a flowchart of a set of steps that a system could perform to laminate the layers (102, 104, 106, 108, 110, 112, 114) of the materials sheet (400). The steps of FIG. 4 may be performed by a lamination machine (510) such as that shown in FIG. 14. The lamination machine (510) comprises a sheet tray (512) configured to accept and hold in place the materials sheet (400) after the collation step (200), a heating or cooling element (514) configured to heat or cool the materials sheet (400) to a specific temperature over a specific period of time, and a pressure grip (508) configured to apply a specific pressure over the entire materials sheet (400) throughout the lamination process. Such "specific" temperatures and times are predetermined and, to this end, the term "predetermined" may be used interchangeably with the term "specific" herein. By way of example, the predetermined temperature is between approximately 130 degrees Celsius and approximately 170 degrees Celsius and, by way of further example, is approximately 140 degrees Celsius. Appropriate heating elements may include gas fired burners, electric heating elements with radiant or air blown contact to the materials sheet (400), or other similar heating elements. Appropriate cooling elements may include cooled liquid baths, air blown compressor cooling devices, thermoelectric cooling devices, or other similar cooling devices.

Returning to FIG. 2, FIG. 4, and FIG. 14, the lamination process may be performed by placing the materials sheet (400) in a sheet tray (512) in a step (310), and activating the lamination machine (510) to cause a specific pressure to be applied (312) across a face of the materials sheet (400) in a step (312). In addition, the heating element (514) heats the materials sheet (400) up to a specific temperature at which the heated layers (102, 104, 106, 108, 110, 112, 114) will begin to bond to each other in a step (314) during a heating cycle (306). In one example, one or more of the heated layers (102, 104, 106, 108, 110, 112, 114) increases to a melting temperature to at least partially bond to an adjacent layer (102, 104, 106, 108, 110, 112, 114). The heating cycle (306) of the lamination process lasts for less than approximately 20 minutes, at which time the lamination machine (510) may cease heating for a cooling cycle (308), which lasts for less than approximately 20 minutes, and release the materials sheet (400). In one example, one or more of the cooling layers (102, 104, 106, 108, 110, 112, 114) decreases below the melting temperature to fully bond to the adjacent layer (102, 104, 106, 108, 110, 112, 114). In some embodiments, the heating and cooling cycles (306, 308) may be performed by the same lamination machine (510), which may have both a heating and a cooling element, while in others there may be a separate machine for each cycle (306, 308), with the materials sheet (400) being manually moved between cycles (306, 308), or automatically moved by a robotic arm. Once the materials sheet (400) is in place for the cooling cycle (308) in a step (316), a specific pressure is applied (318) across the face of the materials sheet (400) while being cooled in a step (320). As the heated layers (102, 104, 106, 108, 110, 112, 114) of the materials sheet (400) cool and return to their ambient state they will respectively bond to each other, resulting in rigid and unified materials sheet (400).

As discussed above, laminating the materials sheet (400) through the heating and cooling cycles (306, 308) is a single-step lamination process. In other words, in the present example, lamination of the materials sheet (400) does not include two or more lamination processes. This single-step lamination process has various heating and cooling cycles (306, 308) that thermally expand and contract the layers (102, 104, 106, 108, 110, 112, 114) of the materials sheet (400), which have a variety of coefficients of thermal expansion. While lateral alignment of the layers (102, 104, 106, 108, 110, 112, 114) is sufficiently retained during expansion and contraction of the materials sheet (400) in the present example, such expansion and contraction effectively limits the size of the materials sheet (400) that may be laminated in the single-step lamination process. In one example, the materials sheet (400) is sized to produce less than 54 bodies (116) of respective payment cards (100). More particularly, the materials sheet (400) is sized to produce less than or equal to 45 bodies (116) for respective payment cards (100). Accordingly, the present example of the single-step lamination process does not accommodate an alternative materials sheet (not shown) sized to produce greater than or equal to 54 bodies (116) due to the misalignment of layers (102, 104, 106, 108, 110, 112, 114) during heating and cooling cycles (306, 308).

Figure 5:
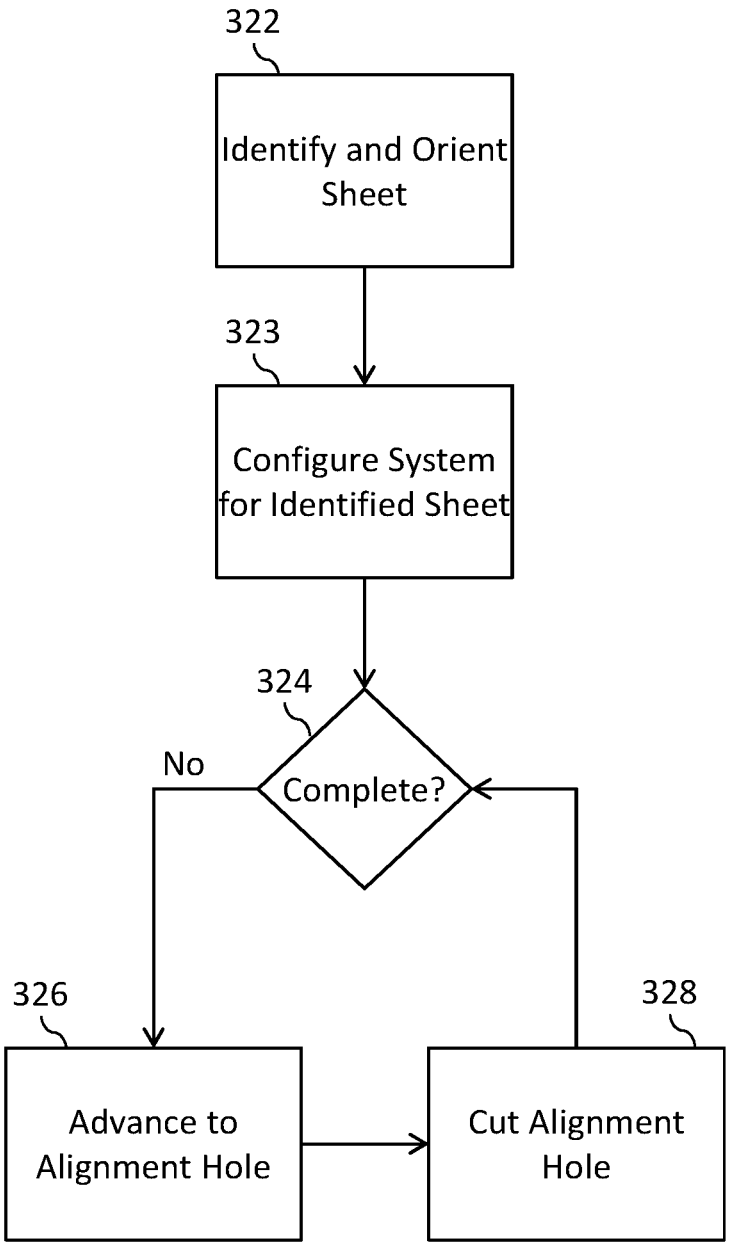
FIG. 5 is a flowchart of a set of steps that a system could perform to register the materials sheet with a milling system.
Figure 15:
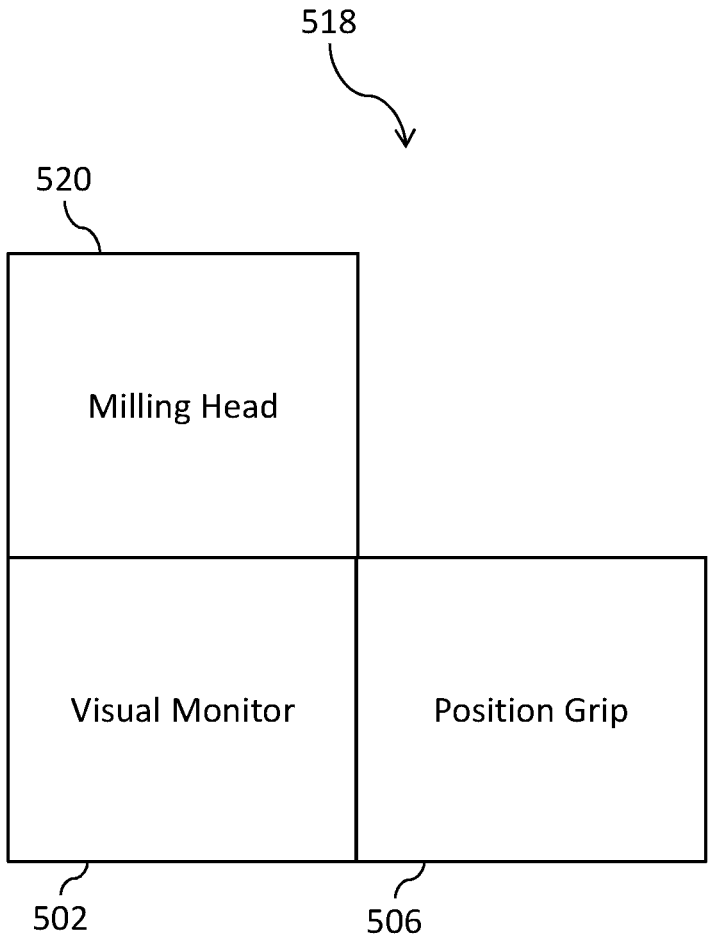
FIG. 15 is a schematic view of a registration machine that may be used during the registration process of FIG. 5.

FIG. 5 is a flowchart of a set of steps that a system could perform to register the materials sheet (400) with a milling system. The steps of FIG. 5 may be performed by a system such as the registration machine (518) of FIG. 15. The registration machine (518) has a milling head (520) that can be used to mill, cut, drill, or otherwise remove material from the materials sheet (400), including being able to cut, mill, or drill into the metal layer (108). The milling head (520) may be automatically operated based upon pre-configured instructions, in response to feedback from one or more visual monitors (502), or both. A position grip (506) may hold the materials sheet (400) in place while the milling head (520) and visual monitors (502) are operated. At the registration step (204), material is removed from the materials sheet (400) with a drilling motion so the position grip (506) maintains the materials sheet's (400) position while receiving applied drilling forces. One such drilling motion includes a rotating cutting bit and advancing cutting bit transversely into the face of the materials sheet (400).

Returning to FIG. 2, FIG. 5, and FIG. 15, the registration machine (518) may be used to identify and orient the materials sheet (400) in a step (322). This could include using the visual monitors (502) to identify one or more characteristics of the materials sheet (400) (e.g., determining its overall dimensions, position and orientation within a cutting area, or other characteristics) to uniquely identify the materials sheet (400) or one or more areas of the materials sheet (400). Such a reference indicator (402) provides unique identification that may include identifying a serial number, barcode, QR code, or other unique identifier, or identifying one or more other types of visual markers. Once the characteristics and other information has been determined for the materials sheet (400), the registration machine (518) may be configured for the identified materials sheet (400) in a step (323) until configuration is completed in a step (324). This could include, for example, activating the position grip (506) to reposition the materials sheet (400) and hold in place within the cutting area, selecting an appropriate cutting bit based upon the types of materials known to be within the materials sheet (400), configuring a particular rotational speed or descent speed for a drilling step, or other similar determinations. By way of further example, such configuration in step (323) for determining locations for cutting or drilling by producing CNC instructions could also include using the registration machine (518) to drill one or more alignment holes (404) in the materials sheet (400) based upon an identification of the materials sheet (400) type or characteristics or one or more reference indicators (402) on the face of the materials sheet (400).

Figure 8:
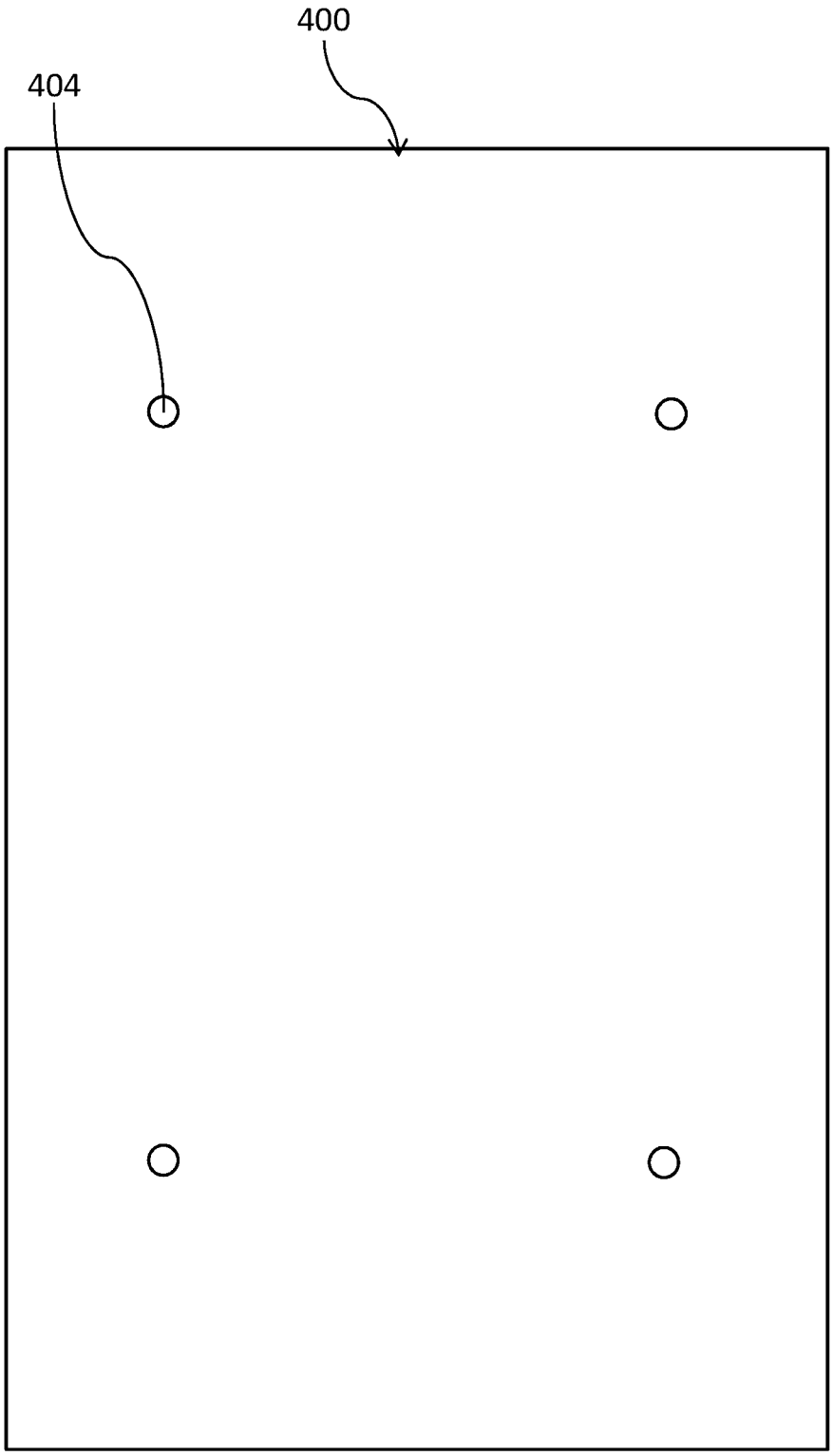
FIG. 8 is a top view of the materials sheet after registration.

With further reference to FIG. 8, the registration machine (518) may then cycle through one or more instruction sets for cutting or drilling alignment holes (404) in the materials sheet (400), including, for each instruction set, advancing a cutting bit to an alignment hole (404) in a step (326) and cutting the alignment hole (404) while the position grip (206) holds the materials sheet (400) in place. This will produce the materials sheet (400) with the locations of one or more reference indicators (402) drilled out to form alignment holes (404). Once the registration step (204) is complete, the prepared materials sheet (400) is ready for final processing and singulation of the individual bodies (116) of the payment cards (100) from the materials sheet (400).

Figure 6:
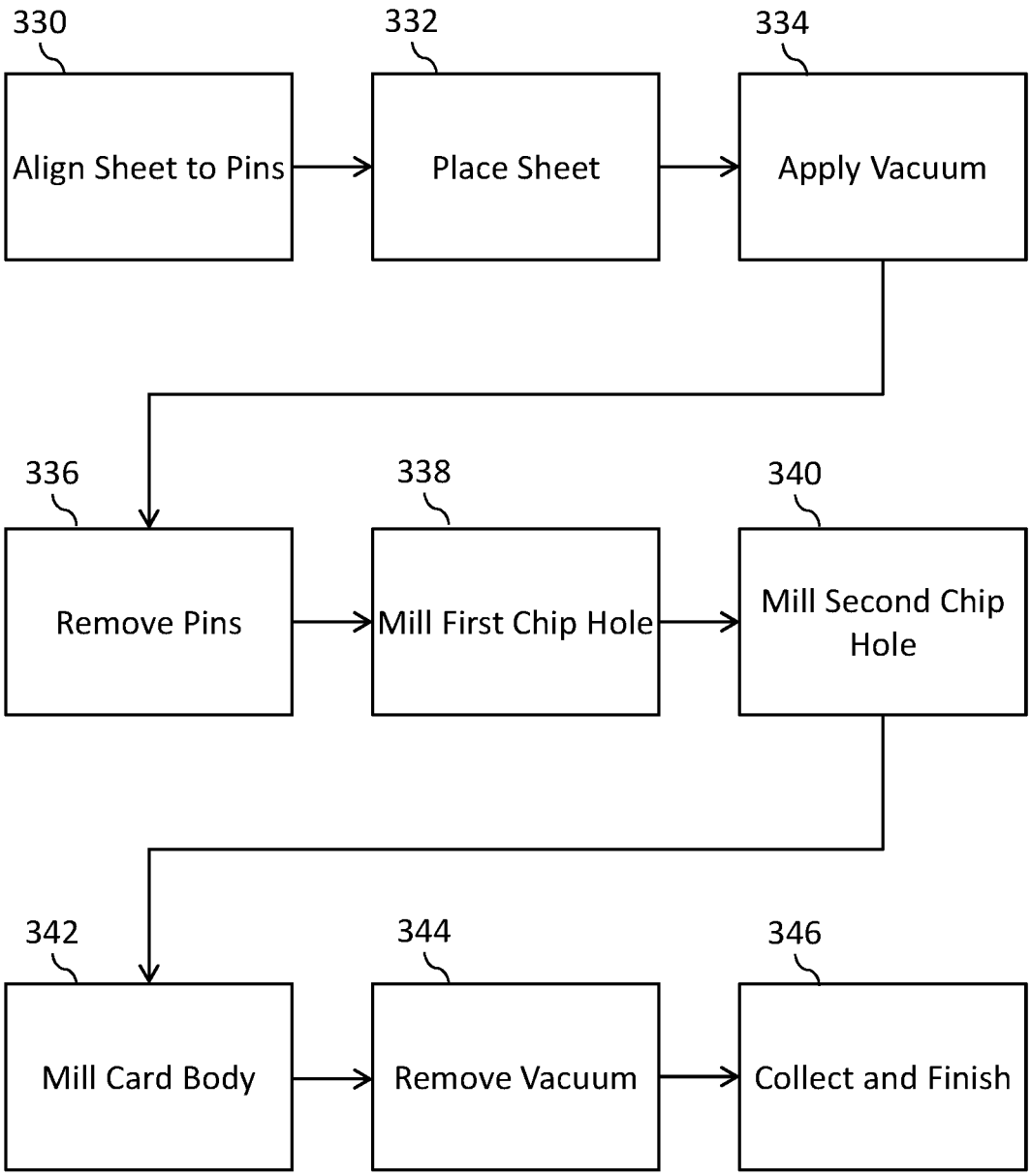
FIG. 6 is a flowchart of a set of steps that a system could perform to singulate the materials sheet and produce the payment card of FIG. 1.

FIG. 6 is a flowchart of a set of steps that a system could perform to singulate the materials sheet (400) and produce individual payment cards (100). The steps of FIG. 6 may be performed by a system such as the singulation machine (522) shown in FIG. 16. Singulation machine (522) comprises a milling head (520) capable of cutting, milling, or drilling into material layers (102, 104, 106, 108, 110, 112, 114) present in the materials sheet (400), a set of pins (524) used to precisely and accurately align the materials sheet (400) on the cutting area, and a vacuum table (526) used to prevent movement of the materials sheet (400) and produce payment cards (100) throughout the process. The set of pins (524) are placed into slots on the cutting area and used to position the materials sheet (400), as each pin will correspond to the alignment hole (404) that was cut into the materials sheet (400) during the registration step (204)

discussed above. The vacuum table (526), when activated, applies a strong gripping force to the materials sheet (400) or bodies (116) resting upon it, thereby allowing the set of pins (524) to be removed, preventing any motion of one or more portions of the materials sheet (400) during cutting.

Returning to FIG. 2, FIG. 6, FIG. 8, and FIG. 16, the registered materials sheet (400) may be aligned with the set of pins (524) in a step (330) and placed on the cutting area in a step (332), with each pin (524) fitting snugly within an alignment hole (404). This may be performed manually, or automatically by a robotic gripping or vacuum arm or other sheet moving device. The singulation machine (522) may then activate the vacuum table (526) to apply suction in a step (334) to the materials sheet (400) and hold it in place. The set of pins (524) may then be removed from the materials sheet (400) in a step (336). The milling head (520) may then be activated to cut, mill, or drill various locations on the materials sheet (400).

Figure 9:
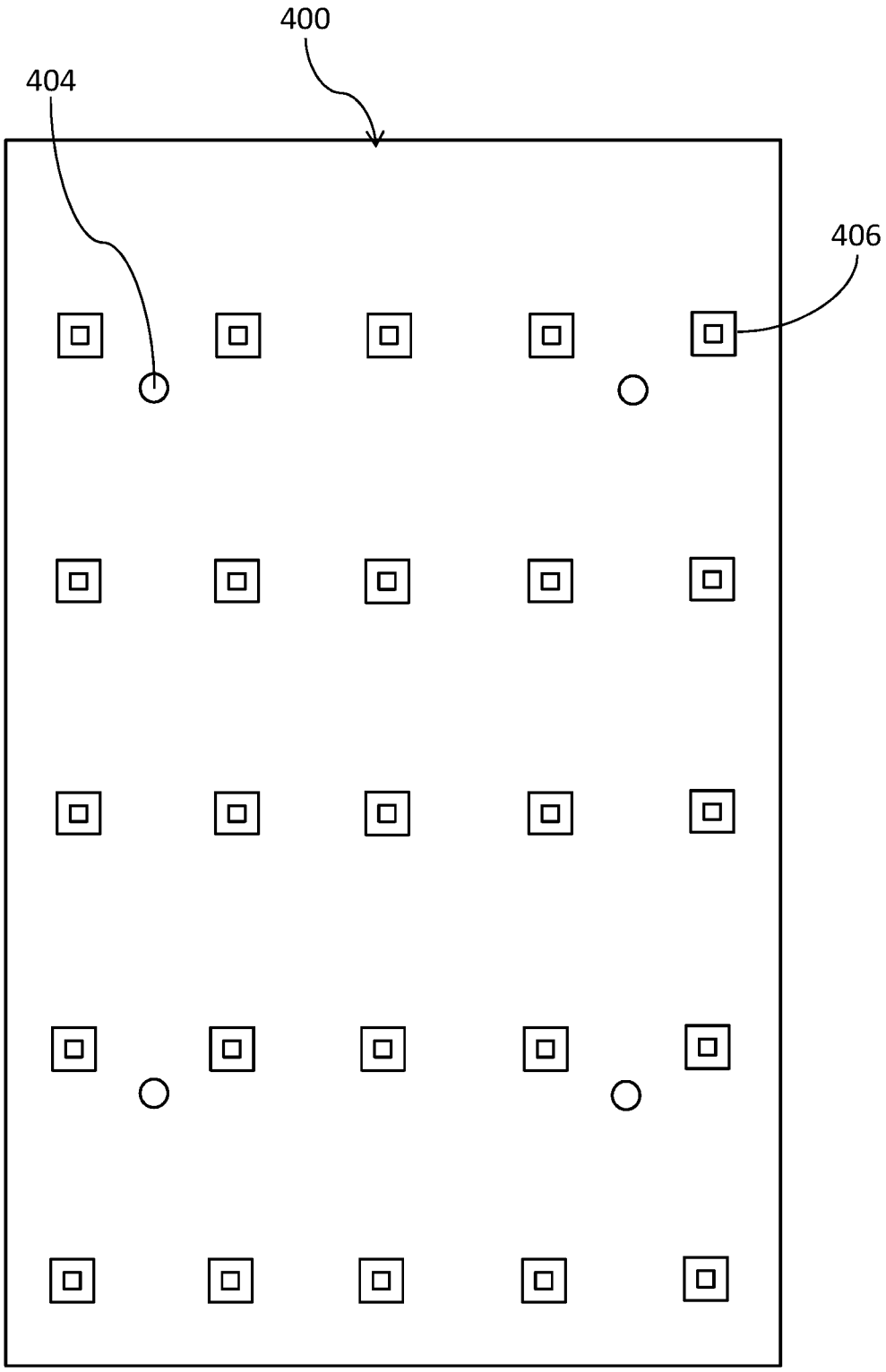
FIG. 9 is a top view of the materials sheet during singulation.
Figure 10:
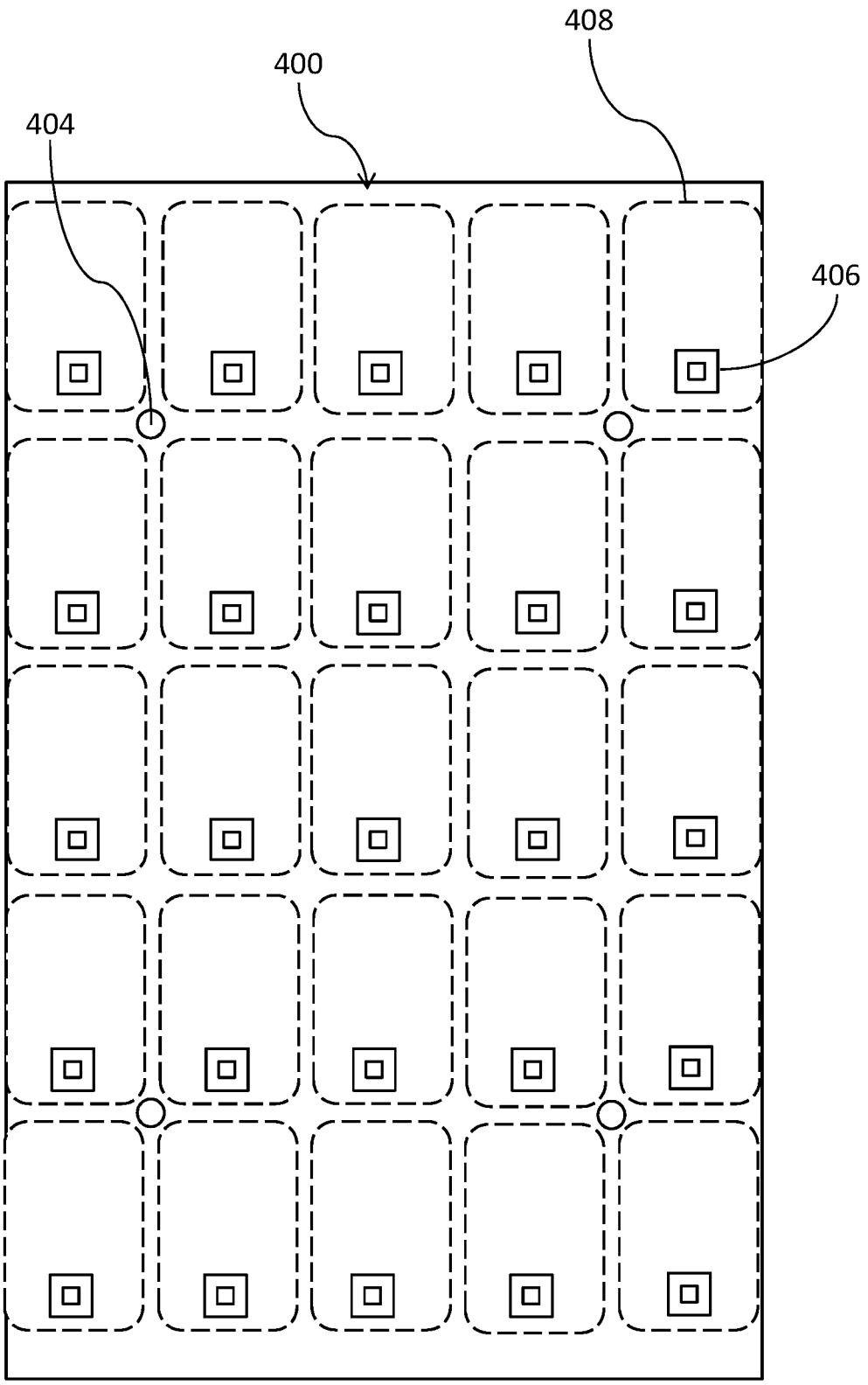
FIG. 10 is a top view of the materials sheet showing a plurality of the payment cards of FIG. 1 that will be produced during singulation.
Figure 12:
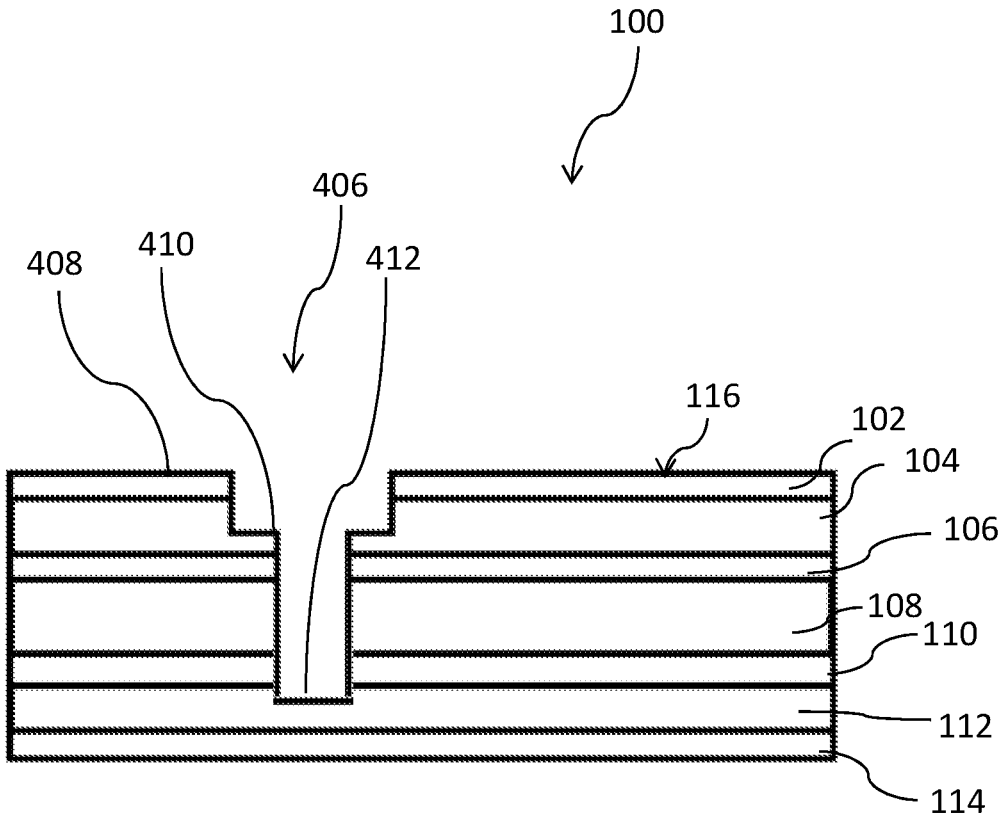
FIG. 12 is a sectional view through a chip opening milled into the plurality of the layers of the payment card of FIG. 1.

In some embodiments, bodies (116) of the payment cards (100) that are milled from the materials sheet (400) may need additional cutting work, including cutting a first chip hole (410) in a step (338) and cutting a second chip hole (412) in a step (340). The stacked chip holes (410, 412), which each have a different depth and a different lateral dimension such as length and/or width, are cut into each body (116) to allow for a security chip to be embedded in the body (116) in order to be "chip" or EMV enabled. FIG. 12 shows a cross sectional view showing the plurality of layers (102, 104, 106, 108, 110, 112, 114) of payment card (100), as well as the first chip hole (410) and second chip hole (412) cut into the multiple layers to form chip opening (406). As can be seen in the present example, the second chip hole (412) extends at least partially into the metal layer (108) as a blind hole from a front face (408), while the first chip hole (410) extends into the printed layer (104) from the front face (408), but not into the metal layer (108), as another blind hole. More particularly, in the present example, the chip hole (412) extending through the metal layer (108) and partially into print layer (112). The chip opening (406) may be sized to receive an EMV security chip, which is comprised of an embedded chip that fits within the second chip hole (412) and a chip contact pad which fits within the first chip hole (410). Cutting the chip opening via steps (338, 340) may be done for each body (1116) before any single body (116) is cut from the materials sheet (400), as shown in FIG. 9. More particularly, FIG. 9 shows the materials sheet (400) with a set of chip openings (406) cut into the layers (102, 104, 106, 108) as two concentric squares, with each chip opening (406) being intended for a single payment card (100) post processing, as can be seen by the outlines shown in FIG. 10.

Figure 11:
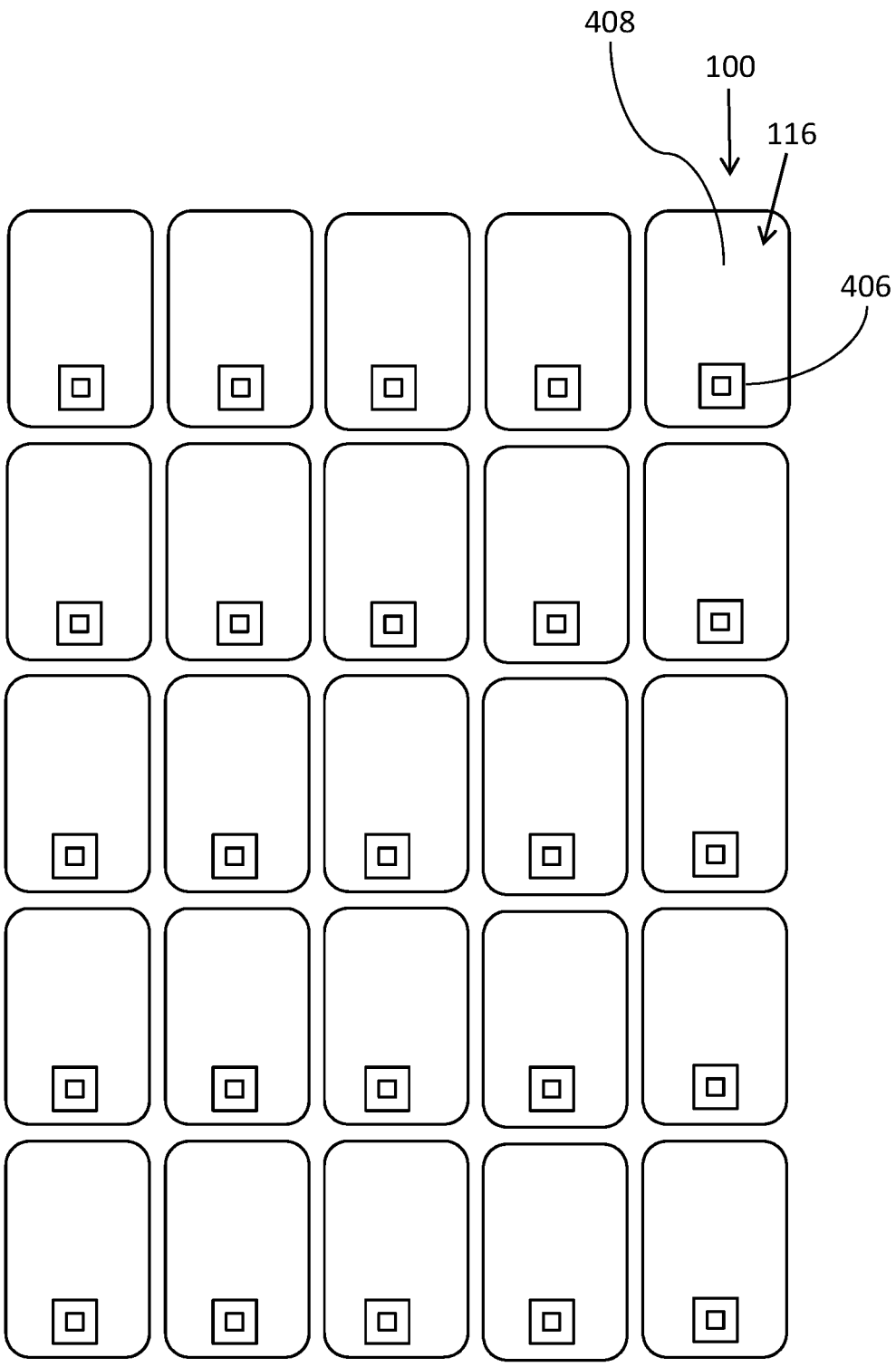
FIG. 11 is a top view of the plurality of the payment cards of FIG. 10 produced from the materials sheet after singulation.
Figure 16:
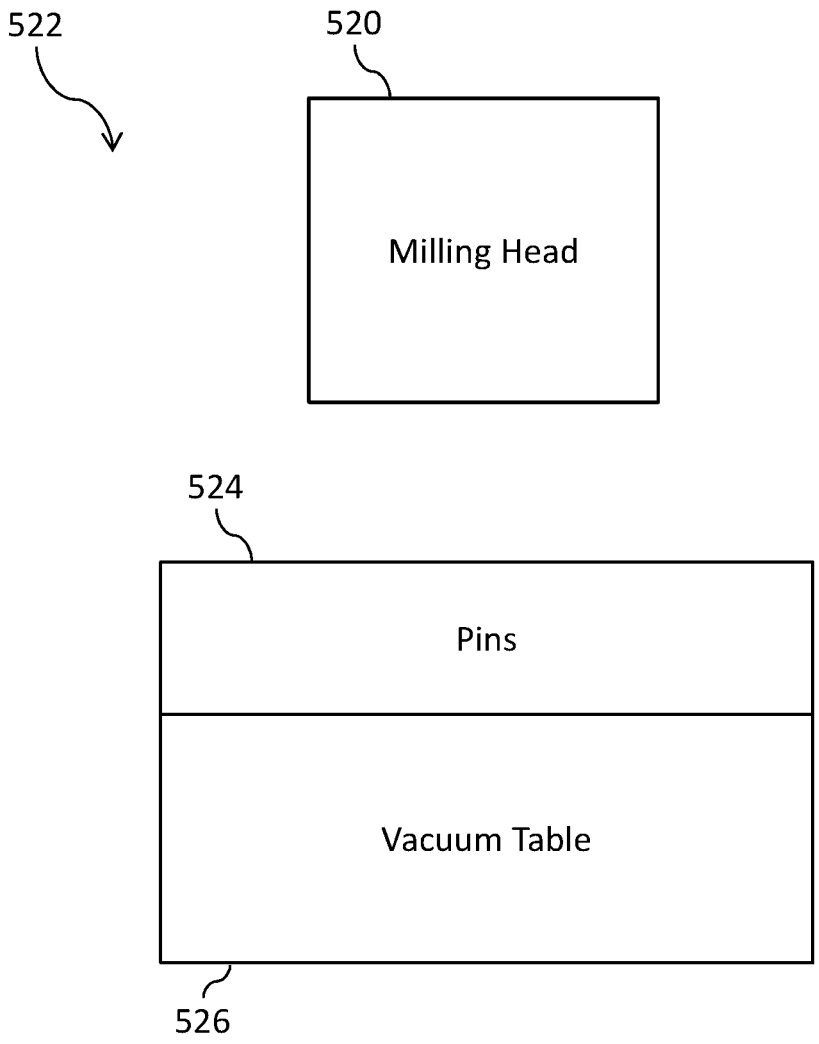
FIG. 16 is a schematic view of a singulation machine that may be used during the singulation process of FIG. 6.

With respect to FIG. 6, FIG. 11, and FIG. 16, the milling head (520) cuts or mills respective bodies (116) for each payment card (100) to produce a set of payment cards (100) from the materials sheet (400), as can be seen in a step (342) of FIG. 11. FIG. 11 shows the set of newly produced bodies (116) of payment cards (100), with the remainder of the materials sheet (400) having been cut or milled away. Each body (116) of the payment card (100) may still be held to the vacuum table (526) throughout this process, or may be released and removed from the cutting area by a manual or automated process as they are cut from the materials sheet (400). Alternately, once all of the bodies (116) have been cut as shown in FIG. 11, the vacuum may be removed in a step (344) by deactivating the entire table (526) and the bodies (116) of the payment cards (100) may be collected and finished in a step (346). Finishing may include a polishing step to smooth the lateral edges of the bodies (116) and remove imperfections, which may be performed by a separate device, or may be performed by the milling head (520) during or after cutting in step (342). Finished bodies (116) of payment cards (100) may be provided to payment card providers as blanks that can be completed and personalized for individual card holders by modifying one or more surface, such as a blank surface, of payment card (100). Further modifications may include adding additional security features such as EMV chips being embedded within the chip opening (406), magnetic strips being adhered to the surface, adding additional surface letter printing or engraving of features such as card holder names, account numbers, expiration dates, colors, designs, or logos, and other modifications.

It will be apparent to one of ordinary skill in the art, in light of this disclosure, that variations on the produced payment card (100) and production process disclosed above exist. For example, the numbers and types of layers (102, 104, 106, 108, 110, 112, 114), materials, thicknesses, and arrangement may be varied. The particular acts performed in each disclosed step of the production process may occur in a different order, may occur in parallel, or some steps may be omitted. For example, in some implementations, the chip openings (406) may be cut into the materials sheet (400) during the registration step (204) rather than during the singulation step (206). Additionally, the hardware used during the process may vary from that which is shown, for example, the registration machine (518) and the singulation machine (522) may be the same device in some embodiments. Additionally, it should be understood that chip openings (406) are not required to be cut into each payment card (100), as some payment cards may be used for purposes that do not require chip installation.

While reference is made to visual monitors (502) being used to identify a sheet, a position or location on a sheet, or another sheet characteristic, it should be understood that other ways to identify a sheet or a sheet location will suffice. This could include, for example, RFID communication, magnetic field detection of magnetic beacons, and other forms of wireless data communication. While not explicitly mentioned or shown, it should also be understood that any system or machine which can perform automated or semi-automated tasks and determinations may have a processor, memory, storage device, network device, and other components that may commonly be found on commercially available devices having the same or similar functions.

It should be understood that any one or more of the teachings, expressions, embodiments, examples, etc. described herein may be combined with any one or more of the other teachings, expressions, embodiments, examples, etc. that are described herein. The following-described teachings, expressions, embodiments, examples, etc. should therefore not be viewed in isolation relative to each other. Various suitable ways in which the teachings herein may be combined will be readily apparent to those of ordinary skill in the art in view of the teachings herein. Such modifications and variations are intended to be included within the scope of the claims.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

What is claimed is:

1. A method for producing a plurality of transaction cards with each transaction card respectively having a set of layers, wherein the set of layers includes a first overlay, a first printed layer, a first bonding layer, a metal layer, a second bonding layer, a second printed layer, and a second overlay, the method comprising:

(a) collating the set of layers to produce a loose materials sheet, wherein the set of layers of the loose materials sheet are tacked together;

(b) laminating the loose materials sheet to produce a finished materials sheet, wherein the finished materials sheet is rigid and unified;

(c) registering the finished materials sheet to add a set of alignment holes;

(d) placing the finished materials sheet on a vacuum table via the set of alignment holes; and (e) singulating the finished materials sheet to produce a set of transaction card bodies respectively for the plurality of transaction cards.

2. The method of claim 1, wherein collating the set of layers further comprises:

(a) capturing a set of position data for each of the set of layers using a visual monitor;

(b) positioning each of the set of layers based upon the set of position data; and (c) tacking each layer of the set of layers to an adjacent layer using a spot-welding head.

3. The method of claim 1, wherein laminating the loose materials sheet further comprises:

(a) performing a heating cycle on the loose materials sheet to cause each of the layers to heat and partially bind to an adjacent layer across the lateral entirety of the layers; and (b) performing a cooling cycle on the loose materials sheet to cause each of the layers to cool and fully bind to the adjacent layer across the lateral entirety of the layers.

4. The method of claim 3, wherein the heating cycle lasts for less than approximately 20 minutes to heat the layers to at least a melting temperature, and wherein the cooling cycle lasts for less than approximately 20 minutes to cool the layers below the melting temperature.

5. The method of claim 4, wherein the loose materials sheet has a face and is placed under pressure across the face during the heating cycle and the cooling cycle.

6. The method of claim 4, wherein the cooling cycle uses a liquid cooled rack to cool the loose materials sheet below the melting temperature.

7. The method of claim 3, wherein at least one of the first overlay, the first printed layer, the first bonding layer, the second bonding layer, the second printed layer, and the second overlay includes a plastic.

8. The method of claim 7, wherein performing the heating cycle and the cooling cycle defines a lamination process in which the first overlay, the first printed layer, the first bonding layer, the metal layer, the second bonding layer, the second printed layer, and the second overlay fully bind together in a single-step such that laminating the first overlay, the first printed layer, the first bonding layer, the metal layer, the second bonding layer, the second printed layer, and the second overlay does not include two or more lamination processes.

9. The method of claim 1, wherein registering the finished materials sheet further includes:

(a) identifying and orienting the finished materials sheet;

(b) identifying a set of reference indicators present on a face of the finished materials sheet with a visual monitor; and (c) cutting an alignment hole at a location of each of the set of reference indicators to produce the set of alignment holes, wherein each of the alignment holes passes through each of the set of layers.

10. The method of claim 9, further comprising providing a sheet identification to a singulation machine, wherein the sheet identification is used by the singulation machine to configure a set of cutting instructions that, when executed by the singulation machine, will produce the set of transaction card bodies.

11. The method of claim 1, wherein singulating the finished materials sheet further includes:

(a) aligning the finished materials sheet on a vacuum table using a set of pins and placing the finished materials sheet on the vacuum table;

(b) activating the vacuum table to hold the finished materials sheet in place;

(c) removing the set of pins from the finished materials sheet; and (d) cutting the finished materials sheet with a milling head to produce the set of transaction card bodies.

12. The method of claim 1, further comprising:

(a) cutting a first set of chip holes into the finished materials sheet with a milling head; and (b) cutting a second set of chip holes into the finished materials sheet with the milling head, wherein each first chip hole is positioned concentrically within each respective second chip hole.

13. The method of claim 12, wherein the first chip hole has a first depth that extends at least partially into the metal layer, and wherein the second chip hole has a depth that extends into the first printed layer and does not extend into the metal layer.

14. A method for a plurality of transaction cards with each respective transaction card having a set of layers, wherein the set of layers include, in order, a first overlay, a first printed layer, a first bonding layer, a metal layer, a second bonding layer, a second printed layer, and a second overlay, the method comprising:

(a) collating the set of layers to produce a loose materials sheet, wherein the set of layers of the loose materials sheet are tacked together;

(b) laminating the loose materials sheet to produce a finished materials sheet, wherein the finished materials sheet is a rigid and unified;

(c) registering the finished materials sheet to add a set of alignment holes;

(d) using the set of alignment holes, placing the finished materials sheet on a vacuum table; and (e) singulating the finished materials sheet to produce a set of transaction card bodies, wherein collating the set of layers further includes:

(i) capturing a set of position data for each of the set of layers using a visual monitor, (ii) positioning each of the set of layers based upon the set of position data, and (iii) tacking each layer of the set of layers to an adjacent layer using a spot-welding head, wherein laminating the loose materials sheet further includes:

(i) performing a heating cycle on the loose materials sheet to cause each of the layers to heat and partially bind to an adjacent layer across the lateral entirety of the layers, and (ii) performing a cooling cycle on the loose materials sheet to cause each of the layers to cool and fully bind to the adjacent layer across the lateral entirety of the layers, wherein registering the finished materials sheet further includes:

(i) identifying and orienting the finished materials sheet, (ii) using a visual monitor, identifying a set of reference indicators present on the face of the finished materials sheet, and (iii) cutting an alignment hole at the location of each of the set of reference indicators to produce the set of alignment holes, wherein each of the alignment holes passes through each of the set of layers, and wherein singulating the finished materials sheet further includes:

(i) aligning the finished materials sheet on a vacuum table using a set of pins and placing the finished materials sheet on the vacuum table, (ii) activating the vacuum table to hold the finished materials sheet in place, (iii) removing the set of pins, and (iv) cutting the finished materials sheet with a milling head to produce the set of cards.

15. The method of claim 14, wherein at least one of the first overlay, the first printed layer, the first bonding layer, the second bonding layer, the second printed layer, and the second overlay includes a plastic.

16. The method of claim 15, wherein performing the heating cycle and the cooling cycle defines a lamination process in which the first overlay, the first printed layer, the first bonding layer, the metal layer, the second bonding layer, the second printed layer, and the second overlay fully bind together in a single-step such that laminating the first overlay, the first printed layer, the first bonding layer, the metal layer, the second bonding layer, the second printed layer, and the second overlay does not include two or more lamination processes.

17. A method for producing a plurality of transaction cards with each transaction card respectively having a set of layers, wherein the set of layers includes a first overlay, a first printed layer, a first bonding layer, a metal layer, a second bonding layer, a second printed layer, and a second overlay, the method comprising:

(a) laminating a loose materials sheet of the first overlay, the first printed layer, the first bonding layer, the metal layer, the second bonding layer, the second printed layer, and the second overlay together thereby producing a finished materials sheet, wherein the finished materials sheet is rigid and unified for producing the plurality of transaction cards therefrom.

18. The method of claim 17, wherein at least one of the first overlay, the first printed layer, the first bonding layer, the second bonding layer, the second printed layer, and the second overlay includes a plastic.

19. The method of claim 18, wherein laminating the first overlay, the first printed layer, the first bonding layer, the metal layer, the second bonding layer, the second printed layer, and the second overlay together further comprises:

(a) performing a heating cycle on the first overlay, the first printed layer, the first bonding layer, the metal layer, the second bonding layer, the second printed layer, and the second overlay to cause each of the first overlay, the first printed layer, the first bonding layer, the metal layer, the second bonding layer, the second printed layer, and the second overlay to heat and partially bind to together; and (b) performing a cooling cycle on the first overlay, the first printed layer, the first bonding layer, the metal layer, the second bonding layer, the second printed layer, and the second overlay to cause each of the first overlay, the first printed layer, the first bonding layer, the metal layer, the second bonding layer, the second printed layer, and the second overlay to cool and fully bind together.

20. The method of claim 19, wherein performing the heating cycle and the cooling cycle defines a lamination process in which the first overlay, the first printed layer, the first bonding layer, the metal layer, the second bonding layer, the second printed layer, and the second overlay fully bind together in a single-step such that laminating the first overlay, the first printed layer, the first bonding layer, the metal layer, the second bonding layer, the second printed layer, and the second overlay does not include two or more lamination processes.

* * * * *